United States Patent [19]

Sutton

[11] 4,143,805

[45] Mar. 13, 1979

[54] CONTAINER LATCHING ARRANGEMENT

[75] Inventor: John T. Sutton, Belgrade, Me.

[73] Assignee: Keyes Fibre Company, Waterville, Me.

[21] Appl. No.: 834,177

[22] Filed: Sep. 19, 1977

[51] Int. Cl.[2] ..... B65D 5/66

[52] U.S. Cl. ..... 229/44 R; 220/4 B; 220/339

[58] Field of Search ..... 150/0.5; 220/4 B, 4 E, 220/339, 306, 307; 229/2.5 R, 44 R, 43 R; 206/519, 508

[56] References Cited

U.S. PATENT DOCUMENTS

| | | | |
|---|---|---|---|
| 3,539,552 | 11/1970 | Mounts et al. | 206/519 |
| 3,620,411 | 11/1971 | Rump | 229/2.5 |
| 3,716,164 | 2/1973 | Fennema | 220/306 |
| 3,795,360 | 3/1974 | Bianchi et al. | 220/306 |
| 3,876,130 | 8/1975 | Haase | 229/44 R |
| 3,902,540 | 9/1975 | Commisso | 229/2.5 R |
| 3,933,295 | 1/1976 | Congleton | 220/4 E |
| 3,968,921 | 7/1976 | Jewell | 220/307 |
| 3,977,595 | 8/1976 | Hillgenberg | 229/2.5 R |
| 3,984,027 | 10/1976 | Smith | 220/306 |

*Primary Examiner*—Herbert F. Ross
*Attorney, Agent, or Firm*—Connolly and Hutz

[57] ABSTRACT

A container comprises two mating portions which are latched together for packaging a product therebetween with the latching arrangement including a slot in at least two spaced corners of the peripheral rim on one portion and corresponding tongues on the other mating portion.

6 Claims, 10 Drawing Figures

Fig. 1.
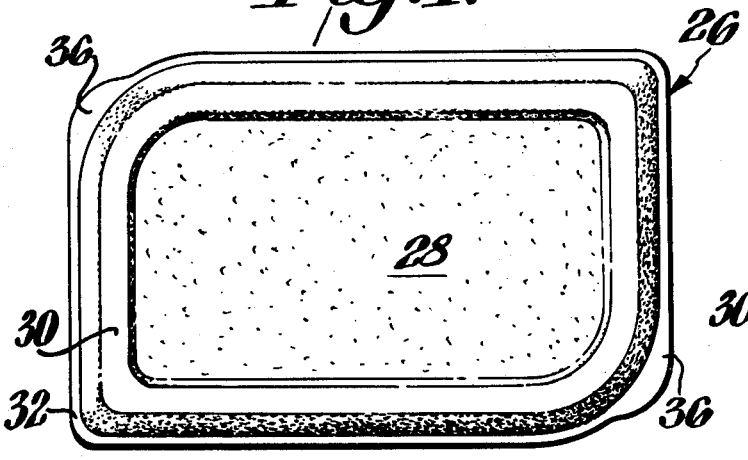
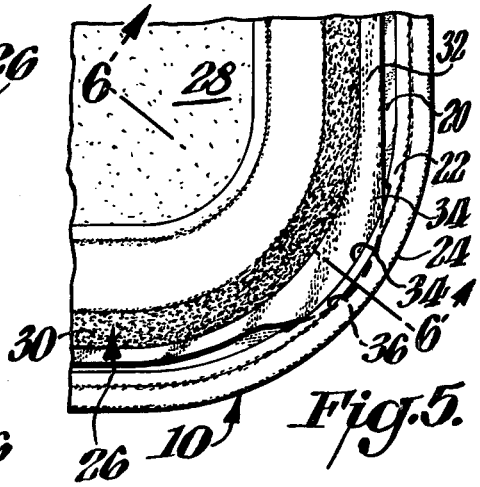
Fig. 5.
Fig. 2.
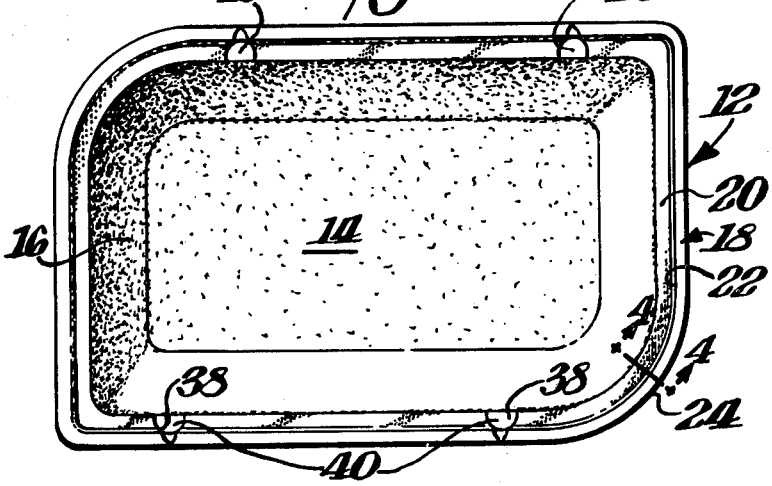
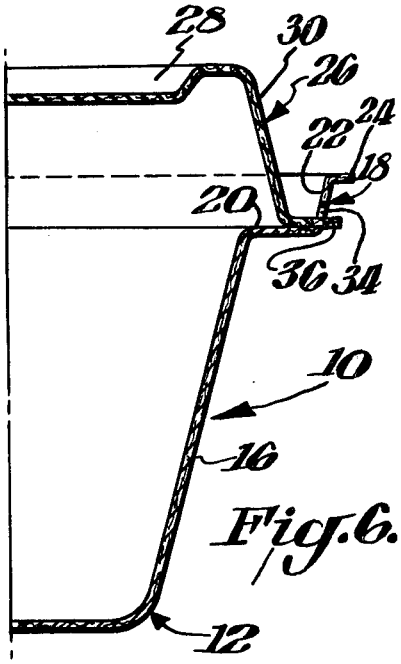
Fig. 6.
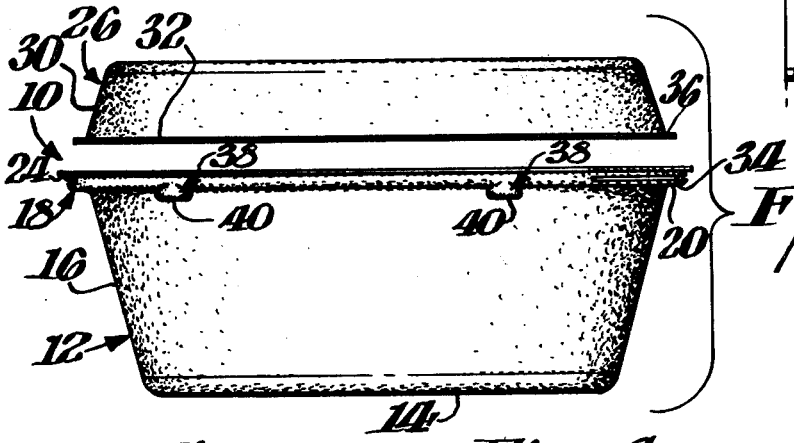
Fig. 3.
Fig. 8.
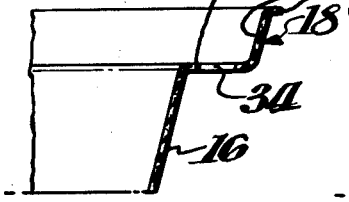
Fig. 4.
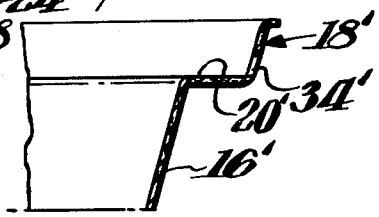
Fig. 7.
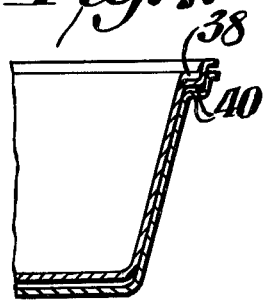

CONTAINER LATCHING ARRANGEMENT

BACKGROUND OF THE INVENTION

This invention relates to the field of containers such as used for packaging retail products and has particular adaptability in the field of disposable containers for packaging fast food items and the like.

The prior art has employed a variety of containers for various purposes. One area of particular concern with the prior art is the provision of suitable locking mechanisms. It is known in the prior art, for example, to utilize a straight tongue-slot arrangements such as disclosed in U.S. Pat. No. 3,968,921. Another arrangement disclosed in U.S. Pat. No. 3,876,130 utilizes a flange-in-slot recess type. A still further arrangement disclosed in commonly assigned copending application Ser. No. 769,567, filed Feb. 17, 1977 incorporates a dual tongue for fitting in a pair of slots.

SUMMARY OF THE INVENTION

An object of this invention is to provide a locking arrangement for containers which is reliable and effective in use and lends itself to ease of manufacture.

A further object of this invention is to provide such an arrangement which utilizes spaced corners of the container as the location for the locking elements.

In accordance with this invention a container comprises two mating portions which are latched together for packaging a product therebetween with the latching arrangement including a slot in at least two spaced corners of the peripheral rim on one portion and corresponding tongues on the other mating portion.

The concepts of this invention may be employed with a hinged lid or a removable lid.

In the preferred practice of this invention the peripheral rim of the bottom portion is flat to form a ledge upon which the peripheral rim of the top portion fits. The slots may be provided in the horizontal surface or in the vertical wall of the ledge.

THE DRAWINGS

FIG. 1 is a top plan view of a lid or top portion of a container in accordance with one embodiment of this invention;

FIG. 2 is a top plan view of the bottom or lower portion of the container used with the lid of FIG. 1 in accordance with this invention;

FIG. 3 is a side elevation view of the lid and bottom portions illustrated in FIGS. 1-2 prior to mating engagement;

FIG. 4 is a cross-sectional view taken through FIG. 2 along the line 4—4;

FIG. 5 is a top plan view showing the locking action at one corner of the assembled portions of the container illustrated in FIGS. 1-4;

FIG. 6 is a cross-sectional view taken through FIG. 5 along the line 6—6;

FIG. 7 is a cross-sectional view taken through FIG. 3 along the line 7—7 and showing a further bottom portion in nested condition;

FIG. 8 is a cross-sectional view in elevation similar to FIG. 4 showing a variation thereof;

DETAILED DESCRIPTION

Figure 10:
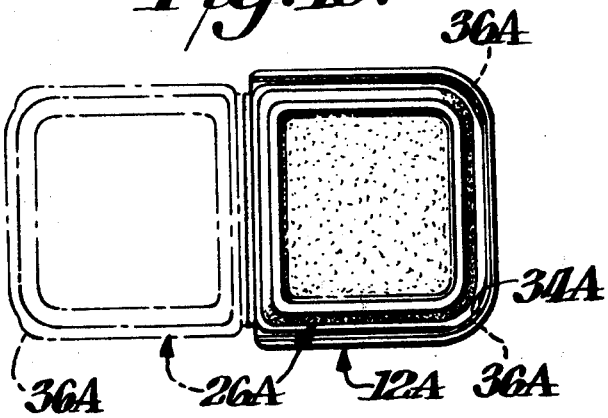
FIG. 10 is a top plan view of the container shown in FIG. 8.

FIGS. 1-7 illustrate a container 10 in accordance with one embodiment of this invention. As indicated therein container 10 includes a bottom or lower portion 12 having a floor 14 and an upstanding peripheral side wall 16 terminating in a peripheral rim 18. As best shown in FIG. 4, rim 18 includes a flat ledge or shoulder 20 with an upstanding flared portion 22 which terminates in edge 24.

An upper portion or lid 26 is designed to mate with bottom portion 12 so that in the closed mating position a product may be packaged therebetween. Lid 26 likewise includes a top wall 28 with a downwardly depending peripheral side wall or skirt 30 terminating in a generally horizontal peripheral rim 32 shaped for generally resting upon ledge 20. As later described, ledge 20 includes a slot 34 at a plurality of corners into which is inserted a corresponding tongue 36 on lid 26. FIG. 3 illustrates each slot to be narrow and horizontal.

Bottom portion 12 and lid 26 may be made in any suitable manner such as from molded pulp along the lines generally described in commonly assigned U.S. Pat. No. 3,542,280. Similarly, other suitable materials such as formed plastic may be used. It is preferable, however, that the portion having the locking tongues be made from a material having some resiliency to effect locking as later described.

As best shown in FIGS. 2, 3 and 7 ledge 20 includes a plurality of indents 38 which extend below the generally planar lower surface of ledge 20 to form a plurality of feet 40. In the stored condition a plurality of such container bottoms 12 may be nested in one of two positions. In one such position feet 40 of one bottom fit in indents 38 of its adjacent bottom. In the other position by reversing alternate container bottoms 180°, feet 40 may be offset from indents 38 to rest directly on the ledge 20 thus spacing edges 24 of adjacent bottom portions a greater distance apart as illustrated in FIG. 7.

As is apparent from the drawings when upper and lower portions 12, 26 are in the closed mating position the respective peripheral rims contact each other along a geometrical configuration having a plurality of corners. In the illustrated arrangement, for example, the geometric configuration has two diametrically opposite right angle corners intermediate two diametrically opposite rounded corners. The arrangement of this invention departs from the approaches taken by the prior art in that the invention utilizes at least two of such spaced corners as the location of the locking means. In this respect as is apparent from FIG. 2, slots 34 are formed in the diametrically opposite rounded corners and similarly tongues 36 are correspondingly located on lid 26. In practice a product would be disposed in lower portion 12 and lid 26 would be placed thereover as generally shown in FIG. 3. Since in the preferred practice of this invention container 10 is made of a resilient type material, a locking action is effected by inwardly depressing the skirt 30 at one of the rounded corners of lid 26 so that its tongue can be inserted in a respective slot. By similar manipulation at the opposite rounded corner, a multi-point locking arrangement is effected at the spaced corners in a manner which requires minimal manipulation. Such multi-point locking arrangement is particularly effective since the spaced locking action is particularly stable.

In the embodiment of the invention best shown in FIGS. 4–6, slots 34 are located in the horizontal portion or shoulder of ledge 20. Accordingly, to effect a locking action tongues 36 are depressed downwardly as shown in FIG. 6 below the normal generally horizontal condition. The tendency to return to this horizontal position causes the tongues 36 to press upwardly against the top wall of slot 34 enhancing the locking action.

FIG. 8, however, illustrates an alternative arrangement wherein slot 34 is disposed in the vertical wall of rim 18 so that the tongues 36 may assume their more normal horizontal condition.

Figure 9:
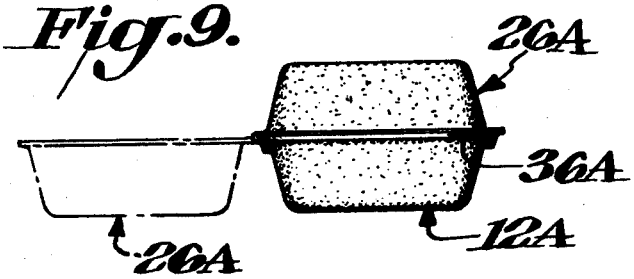
FIG. 9 is an end elevation view of a modified container in accordance with a further embodiment of this invention showing a hinged lid in its opened position in phantom and in its closed position in solid.

FIGS. 1–8 are directed to the practice of the invention wherein lid 26 is completely detached from lower portion 12. The invention, however, may also be practiced in other manners. For example, FIGS. 9–10 illustrate the practice of the invention wherein lid 26A is hinged along one edge 42 of lower portion 12A. In this embodiment the spaced corners which contain the locking elements are at adjacent corners rather than diametrically opposite corners. The general structure of lid 26A and bottom 12A is generally similar to the prior embodiment and accordingly like reference numerals have been used for like parts but designated by the suffix "A". As illustrated in FIG. 10, the locking arrangement thus takes place by providing a pair of slots 34A in either the horizontal or vertical portions of rim 18A for receiving tongues 36A of lid 26A.

As is apparent the invention may be practiced in various manners including the particularly illustrated embodiments. For example the slots may be provided in the top portion and the tongues in the bottom which would result in a container being generally inverted from the illustrated containers. Similarly, the lid and/or the bottom portion may be shallow or deep. Further the slot containing portion may be rigid rather than resilient. These are merely exemplary further practices of the concepts of the invention. The practice of the invention is particularly effective by the utilization of the spaced corners for the locking arrangements which provides an effective locking action that may be accomplished by relatively simple manipulations while the physical arrangements lend themselves to economical mass production techniques.

While the above described embodiments constitute the presently preferred mode of practicing this invention, other embodiments and equivalents are within the scope of the actual invention, which is claimed as:

1. A molded container comprising two non-identical mating portions capable of packaging a product therebetween in the closed mating position thereof, one of said portions being a lower protion with a floor and an upstanding peripheral side wall terminating in a peripheral rim, the other of said portions being an upper portion with a top wall and a depending peripheral side wall terminating in a peripheral rim, said peripheral rims in said closed mating position contacting each other along a geometric configuration having a plurality of corners with one of said rims being disposed inwardly of the other of said rims at at least two of said corners, a narrow horizontal slot in the outward of said rims at only two of said corners, a tongue on the inward rim at said only two corners, said only two corners comprising locking corners, each of said tongues being inserted through a respective of said slots to maintain said portions in said closed position, said peripheral rim of said bottom portion including a ledge having a generally horizontal shoulder and an upwardly extending wall, said slots being in the general area of the juncture of said horizontal shoulder and said upwardly extending wall, said peripheral rim of said upper portion terminating in a horizontal plane and being shaped and dimensioned to fit within said upstanding wall of said ledge and to rest upon said horizontal shoulder, said upstanding wall of said ledge surrounding said peripheral rim of said upper portion at the adjacent walls forming said two locking corners except for said tongues which extend outwardly beyond said upstanding wall of said ledge when said two portions are mated in said closed position, said tongues being generally horizontal when inserted through said slots in said closed position, and said tongues and said slots at said locking corners being the sole detachable locking elements integral with said container.

2. The container of claim 1 wherein said upper portion comprises a lid detached from said lower portion, and said locking corners comprise diametrically opposite corners.

3. The container of claim 1 wherein said upper portion comprises a lid hinged at one edge to said lower portion, and said locking corners comprise a pair of adjacent corners along the edge remote from said hinged edge.

4. The container of claim 1 wherein said locking corners having said slots are of rounded configuration, and said tongues being corresponding rounded edges on said upper portion.

5. The container of claim 1 including a plurality of indents formed in the upper surface of said ledge and extending therebelow to form feet therefrom to facilitate the nesting of a plurality of bottom portions.

6. The container of claim 1 wherein said adjacent walls at each of said locking corners having said tongues are of a curved configuration to form its corner, and its said tongue deviating from the general curvature thereof whereby said tongue is of greater width than the width of said adjacent walls.

* * * * *